United States Patent [19]

Ritter et al.

[11] 4,243,004

[45] Jan. 6, 1981

[54] INJECTION PUMP WITH ELECTRONICALLY CONTROLLED FULL-LOAD STOP

[75] Inventors: Ernst Ritter, Stuttgart; Werner Faupel, Gerlingen; Karsten Hummel, Wendlingen; Johannes Locher, Stuttgart, all of Fed. Rep. of Germany

[73] Assignee: Robert Bosch GmbH, Stuttgart, Fed. Rep. of Germany

[21] Appl. No.: 6,308

[22] Filed: Jan. 24, 1979

[30] Foreign Application Priority Data

Jan. 31, 1978 [DE] Fed. Rep. of Germany ..... 2804038

[51] Int. Cl.[3] ..... F02D 1/04

[52] U.S. Cl. ..... 123/367; 123/358; 123/372

[58] Field of Search ..... 123/140 R, 140 FG, 140 MC

[56] References Cited

U.S. PATENT DOCUMENTS 3,263,662 8/1966 Bart et al. ..... 123/140 MC

FOREIGN PATENT DOCUMENTS 2314450 10/1973 Fed. Rep. of Germany ... 123/140 MC

*Primary Examiner*—Harry N. Haroian

*Attorney, Agent, or Firm*—Edwin E. Greigg

[57] ABSTRACT

An injection pump with a full-load stop, preferably electronically controlled, which is adjustable against the force of a prestressed spring as a result of the control exerted by an electromagnet with a controllable stroke and which, when there is no current in the magnet, is displaceable by means of the spring into its terminal position which determines a reduced full-load quantity. Thus the maximum injection quantity is reduced in accordance with operating conditions and with the operational status of the engine; by this means, environmentally safer and smoother engine operation is possible at all operating conditions. The injection pump is also capable of continuing to function if the electrical or electronic parts fail.

8 Claims, 2 Drawing Figures

INJECTION PUMP WITH ELECTRONICALLY CONTROLLED FULL-LOAD STOP

BACKGROUND OF THE INVENTION

The invention relates to an injection pump of the type described in the preamble of the main claim, such as is known from the German laid-open application No. 2,453,576. There, the stop is adjusted by electronic regulator means via an electric servo-motor and a rotating threaded spindle. If an electrical part fails, the full-load stop remains in the position it has just assumed, which is disadvantageous to the smoothness of engine operation. Thus the full-load stop may, for example, remain in the position which determines the quantity for cold starting, if a defect arises in the electrical apparatus directly during the starting procedure. When operation continues, then there is no effective full-load stop at all.

There is a further full-load stop which is known from German laid-open application No. 1,811,561, which is pivotable by means of an electromagnet. However, in this case there are only two stop positions: one for cold starting and one for warm starting. Intermediate positions, which are dependent for example upon the engine speed, air temperature, charge pressure, or the like, are not possible.

OBJECT AND SUMMARY OF THE INVENTION

It is the object of the present invention to provide an injection pump for Diesel fuel injection internal combustion engines, in which the injection quantity is regulatable by displacement of a regulator rod and limitable by means of a full-load stop, said full-load stop being settable in accordance with various operational values of the engine via an electronic control means. Furthermore, in this invention the full-load stop remains effective even in case of failure of an electrical part, and thereby prevents any undesired oversupply of the quantity of fuel being injected even without regulating the position of the full-load stop.

In order to attain this object, it is proposed that the stop be adjustable by the regulator means via an electromagnet which has a controllable stroke, this adjustment being made against the force of a pre-stressed spring, and further that the stop be displaceable by the spring into its terminal position which determines a reduced full-load quantity when there is no current in the electromagnet.

By employing an electromagnet with a controlled stroke, which adjusts the stop against the force of a prestressed spring, it is further assured that if an electrical part fails the full-load stop is always pushed back into its basic position by the prestressed spring. This basic position is chosen to be such that at full-load no oversupply of fuel mixture is injected, but rather only a reduced full-load quantity. The mechanical functional capability of the injection pump is not impaired, and thus the internal combustion engine may continue to be driven without adverse environmental impact.

In the injection pump embodied in accordance with the invention, an operationally correct reduction of the full-load quantity is obtained and not only the supplying of a starting quantity, such as is known from the prior art.

In order to provide an adaptability to various types of regulators and injection pump sizes, the prestressing of the spring may be made adjustable. Furthermore, it is of particular advantage that at least one and preferably both terminal positions of the stop can be made adjustable with respect to the regulator rod, for the purpose of precisely setting the minimum full-load quantity and, if desired, the maximum required cold starting quantity.

Furthermore, in order to avoid damage to the regulator of the injection pump as well as to limit the control force of the electromagnet, a lost-motion device can be provided between the regulator for the path of the regulator rod and the regulator rod itself. When the regulator rod contacts the stop, the lost-motion device can be penetrated by the regulator, whereby the maximum force brought to bear on the regulator rod by the regulator is thus limited. The lost-motion device advantageously has a prestressed spring, with the amount of prestressing being made adjustable in this case as well.

An embodiment of the stop as a two-armed, pivotable lever is particularly well-suited for subsequent mounting of a full-load stop on an existing injection pump. Under such circumstances, one end of the lever cooperates with the regulator rod, and the other free end cooperates with the stroke-controllable electromagnet. The pivotable lever can be particularly easily supported within an opening in the regulator housing, and the stroke-controllable electromagnet can be mounted on the regulator housing.

As a result of the arrangement of the stroke-controllable electromagnet with a displacement pickup as a controllable servo circuit, full-load characteristic curves of any desired course can be adjusted in dependence on as many engine parameters as desired; that is, the magnet is capable not only of furnishing the excess starting quantity, but also of setting the full-load characteristic curve, which is generated in the normal manner, independently of the mechanical regulator or its characteristics.

Through the inclusion of the displacement pickup, the control servo which is comprised of the electromagnet, the displacement pickup, and the electronic open-loop or closed-loop control means can adjust the stop precisely in accordance with the values which have been selected to be of significance, such as air pressure, engine speed, temperature, charge pressure, and other parameters. The desired value which is dependent on these values is preset by the electronic control means. The current through the electromagnet is varied by an electronic regulator for a period of time sufficient to attain agreement of the actual value of the stop position with this desired value.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
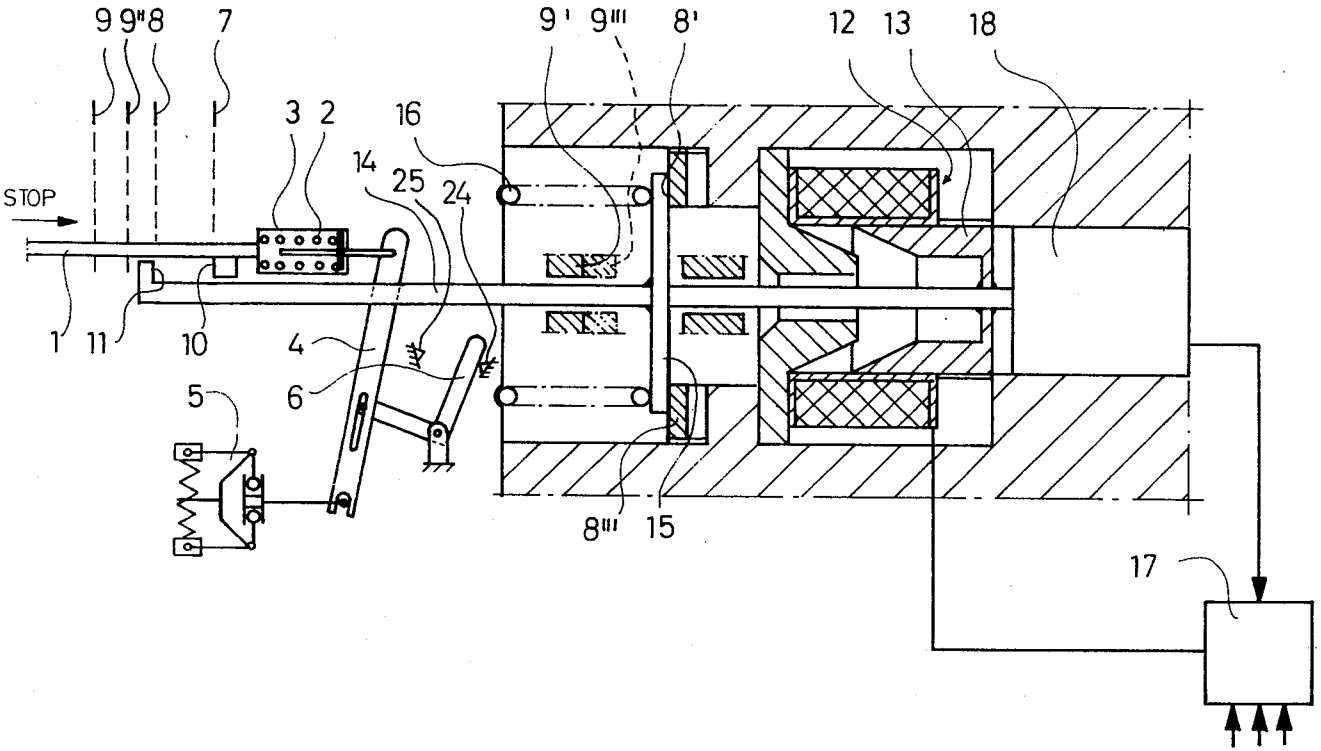
FIG. 1 is a schematic representation of a first embodiment of a full-load stop with a direct coupling of the full-load stop to an electromagnet.

The same reference numerals are used for corresponding parts in both embodiments. In both FIGS. 1 and 2, the regulator rod 1 is displaceable between a stop setting 7 and a maximum starting quantity setting 9, with an intermediate setting 8 for a reduced minimum full-load quantity. This displacement takes place via a lost-motion device 3 which has a prestressed spring 2 and via a regulator rod 4 by means of a centrifugal governor 5 and a desired-value setting 6. The various settings 7, 8 and 9 are indicated with broken lines. In the embodiment of FIG. 1, the displaceability of the regulator rod 1 is limited by a full-load stop 11 whose effect is exerted on a detent 10. The full-load stop 11 is displaceable, by means of an electromagnet 12 whose stroke is controllable, between a setting 8 corresponding to the reduced full-load quantity and a setting 9 corresponding to the maximum starting quantity. For this purpose, the full-load stop 11 is disposed on a displaceable rod 14 that is connected to the armature 13 of the electromagnet 12. A crosspiece 15 is provided on this rod 14 which, at the minimum full-load quantity setting 8, contacts a minimum full-load stop 8' and, at the maximum starting quantity setting 9, contacts a maximum cold-starting quantity stop 9. By means of a prestressed spring 16, the crosspiece 15 is normally held adjacent to the stop 8' when there is no current in the magnet 12. However, when current is supplied to the magnet 12, the crosspiece 15 can move via an electronic control means 17 within a stroke path between the two stops 8' and 9'. The electronic control means 17 detects the operational states and data of the internal combustion engine which are required for full-load quantity regulation, such as coolant temperature, engine speed, air temperature, air or charge pressure, among others, and the desired-value setting 6. In order to provide precise regulation, the position of the rod 14 is fed via a displacement pickup 18 to the electronic control means 17. Thus, particularly in Diesel engines, the fuel injection quantity can be accurately controlled and maintained constantly below the smoke limit, even during either cold or warm engine starting. During warm-starting, a full-load quantity which is merely reduced is injected, and during cold-starting, an increased cold-starting full-load quantity is injected. In the event the electronic control means fails to function properly, there is no current in the magnet 12, so that in every case the crosspiece 15 contacts the stop 8', and only a reduced full-load quantity is injected through the injection pump, which is not shown. The stop 8' may be in the form of a lock nut 8''', so as to provide for easy adjustment.

If the engine does not require a starting quantity which exceeds the full-load quantity, then the setting 9 of the full-load stop 11 and the associated stop 9' are drawn back to a position 9'' which determines the full-load quantity setting and the associated stop 9'''.

Whenever a reduced fuel injection quantity is to be injected, as controlled by the electronic control means 17 and determined by the position of the stop 11, where the reduction is made with respect to a position of the regulator rod 4 which is preset by a mechanic, then the spring 2 of the lost-motion device 3 augments the effect of the electromagnet 12 operating against the force of the spring 16, so that the electromagnet 12 may be chosen to be relatively small, without impairing regulatory precision.

Figure 2:
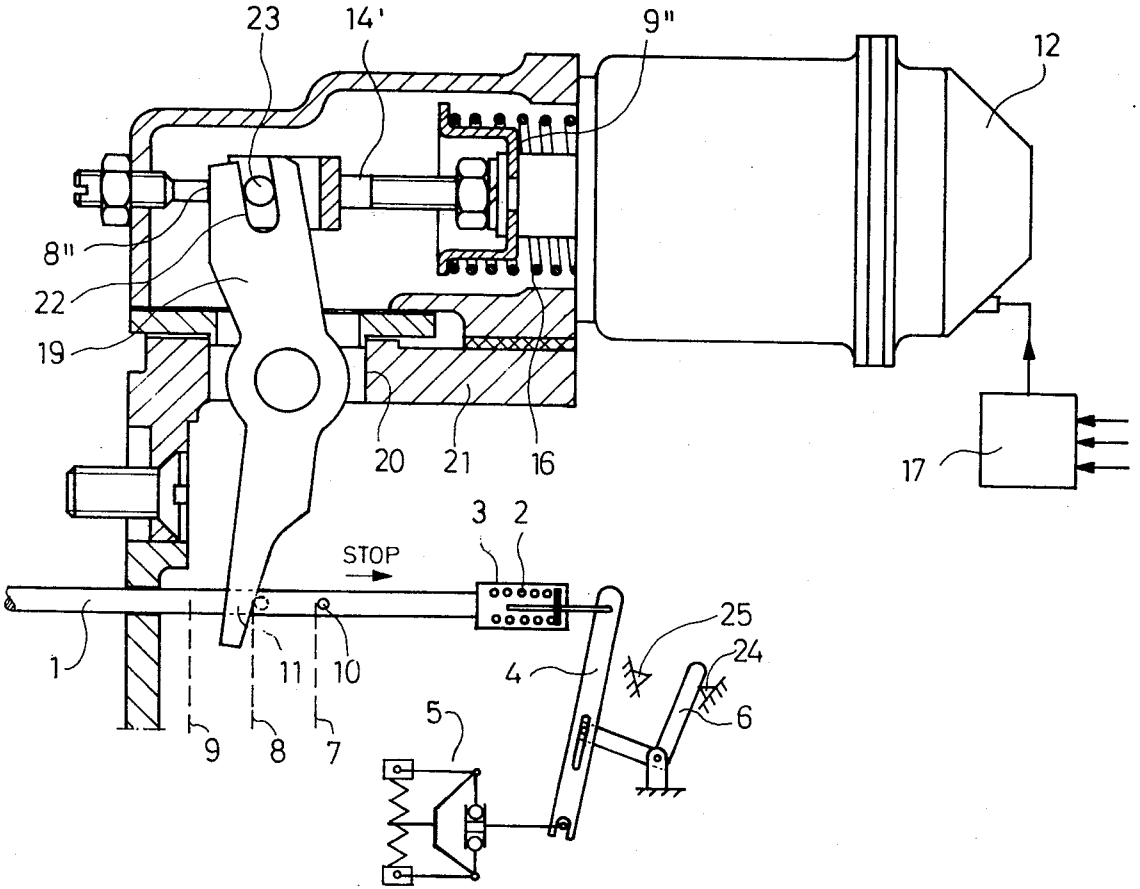
FIG. 2 is a schematic representation of a second embodiment in which the adjustable full-load stop comprises a two-armed lever which is pivotable via the stroke-controlled electromagnet.

In the embodiment of FIG. 2, the full-load stop 11 is formed by a two-armed lever 19, which is pivotably supported within an opening 20 of a regulator housing 21. The end of the lever 19 opposite the stop 11 has a slot 22 which engages a tang 23 of a push rod 14' of the magnet 12. The upper end of the lever 19 contacts the minimum full-load quantity stop 8'', which comprises an adjustable screw, when there is no current in the magnet 12. When the armature is fully energized, the stop 9'' contacts the magnet 12; then when there is no current in the magnet, the prestressed spring 16 immediately displaces the push rod 14' again, so that the lever 19 contacts the stop 8''. In this example, the stop 11 assumes only one of its two terminal positions which are determined by the stops 8'' and 9''.

In both embodiments of FIGS. 1 and 2, a simple starting switch, controlled by a key, may be employed instead of the electronic control means 17 to switch the full-load stop 11 over into one of its two terminal positions, the one position 9 determining the starting quantity or the other position 8 determining the minimum full-load quantity.

In both embodiments, the desired-value setting 6 and the centrifugal governor 5, which comprise the adjustment lever, and the regulator rod 1 are illustrated in their terminal position, which they assume when the engine is not running. The adjustment lever 6 then contacts a terminal stop 24. When the lever 6 is pivoted counterclockwise to its maximum stop 25 during starting, then the regulator rod 1 is displaced until the detent 10 contacts the full-load stop 11, which at this time is in its starting-quantity setting 9 defined by means of the stop 9'.

When the engine has started, then in a known manner the regulator rod 1 is drawn back to its full-load setting or another desired setting by means of the centrifugal governor 5.

The foregoing relates to preferred embodiments of the invention, it being understood that other embodiments and variants thereof are possible within the spirit and scope of the invention, the latter being defined by the appended claims.

What is claimed is:

1. An injection pump for Diesel fuel injected internal combustion engines wherein the quantity of fuel injected is regulated by displacement of a regulator rod means, the stroke of said regulator rod means having a detent means and being de-limited by means of a full-load stop means, said full-load stop means being settable in accordance with operational values of said engine by electronic control means, further wherein said full-load stop means is coupled with an armature of an electromagnet to provide for a predetermined stroke thereof and further means carried by said full-load stop means arranged to cooperate with prestressed resilient means capable of holding said full-load stop means in a terminal position to reduce full-load quantity of fuel injected.

2. An injection pump for Diesel fuel injected internal combustion engines as claimed in claim 1, further wherein said terminal position of said full-load stop means can be set by means of a further stop means which limits the stroke of said armature.

3. An injection pump for Diesel fuel injected internal combustion engines as claimed in claim 1, further wherein at least one terminal position of said full-load stop means is settable relative to said regulator rod means.

4. An injection pump for Diesel fuel injected internal combustion engines as claimed in claim 1, further wherein the regulator rod means comprises a lost-motion device that is positioned in close proximity to a detent means.

5. An injection pump for Diesel fuel injected internal combustion engines as claimed in claim 4, further wherein said lost-motion device includes a pre-stressed spring element, said spring element arranged to control the maximum force exerted on said regulator rod means.

6. An injection pump for Diesel fuel injected internal combustion engines as claimed in claim 1, further wherein said full-load stop means comprises a system of housed levers one of which levers is pivotable by means of said electromagnet.

7. An injection pump for Diesel fuel injected internal combustion engines as claimed in claim 6, further wherein said pivotable lever is supported in an opening in said housing and said electromagnet is mounted on said housing.

8. An injection pump for Diesel fuel injected internal combustion engines as claimed in claim 1, further wherein said resilient means is adjustably mounted relative to said regulator rod means.

* * * * *